United States Patent [19]

Bolton et al.

[11] Patent Number: 4,551,202

[45] Date of Patent: Nov. 5, 1985

[54] VACUUM CONTROL SYSTEM AND METHOD FOR DEWATERING FABRICS

[75] Inventors: Joseph A. Bolton, Queensbury; David J. Salls, Glens Falls, both of N.Y.

[73] Assignee: Albany International Corporation, Menands, N.Y.

[21] Appl. No.: 575,447

[22] Filed: Jan. 31, 1984

[51] Int. Cl.[4] ..... D21F 1/48

[52] U.S. Cl. ..... 162/198; 162/199; 162/252; 162/262; 162/263; 162/274; 415/26; 415/30

[58] Field of Search ..... 162/198, 199, 252, 262, 162/263, 274, 253, 259, 217, 317; 415/30, 36, 26, 13

[56] References Cited

U.S. PATENT DOCUMENTS

| | | | |
|---|---|---|---|
| 1,474,259 | 11/1923 | Heess . | |
| 2,264,169 | 11/1941 | Poirier | 92/51 |
| 2,479,031 | 8/1949 | Tait | 34/18 |
| 2,877,693 | 3/1959 | Poirier | 92/51 |
| 2,922,475 | 1/1960 | Alexander | 162/252 |
| 3,024,839 | 3/1962 | Beachler | 162/364 |
| 3,266,975 | 8/1966 | Cribben | 162/252 |
| 4,146,425 | 3/1979 | Gutzeit | 162/252 |
| 4,308,077 | 12/1981 | Bolton | 162/199 |
| 4,329,201 | 5/1982 | Bolton | 162/198 |
| 4,398,996 | 8/1983 | Bolton | 162/198 |

OTHER PUBLICATIONS

Lavigne, "Instrumentation Applications" Miller Freeman Publications, S. F.; 1979 pp. 208–209.

*Primary Examiner*—Steve Alvo

*Attorney, Agent, or Firm*—Kane, Dalsimer, Kane, Sullivan & Kurcz

[57] ABSTRACT

A vacuum control system and method for dewatering felts or fabrics on a papermaking machine including a suction pipe and a centrifugal exhauster connected to the suction pipe to supply a variable vacuum level. The fabric is passed over a slot in the suction pipe so that suction applied therethrough will dewater the fabric. A variable drive device is connected to the centrifugal exhauster for its operation with the variable drive device being responsive to an increase in the vacuum level in the suction pipe as fabric permeability decreases to correspondingly increase the speed of the centrifugal exhauster so as to increase the vacuum level in the suction pipe as a function of the decrease in felt permeability.

13 Claims, 6 Drawing Figures

FIG.2A
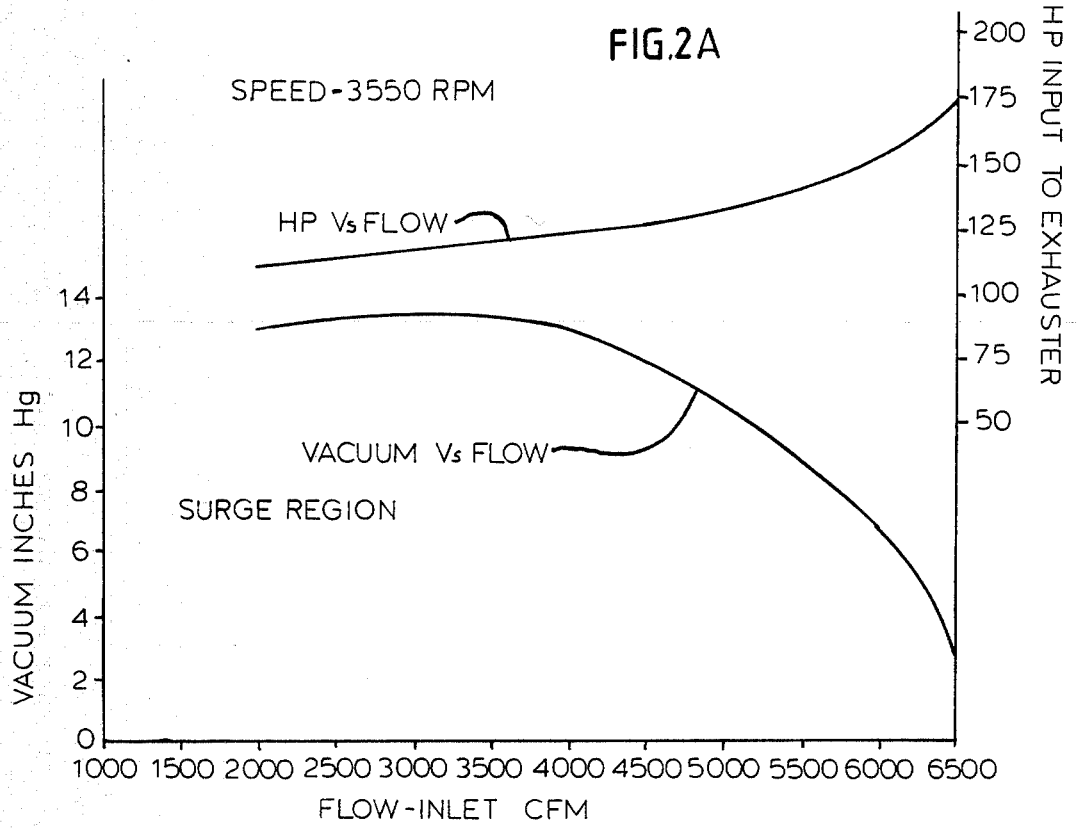
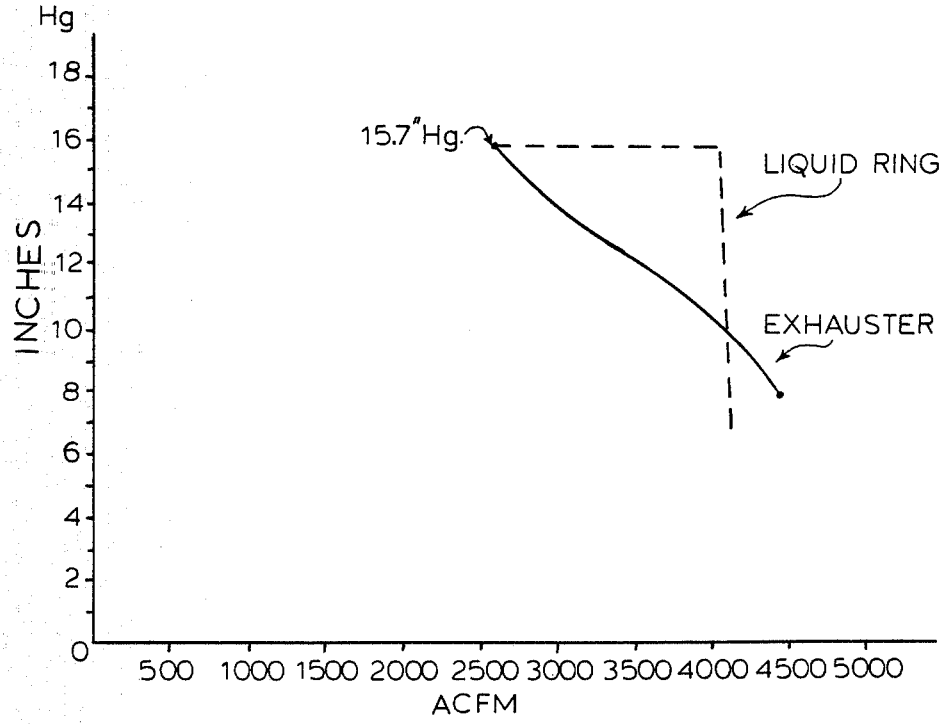
FIG.3C

VACUUM CONTROL SYSTEM AND METHOD FOR DEWATERING FABRICS

FIELD OF THE INVENTION

The present invention relates to a vacuum control system for dewatering applications, particularly one that utilizes a centrifugal exhauster.

BACKGROUND OF THE INVENTION

It is well known in the papermaking industries to use vacuum or suction pipe systems in dewatering. Such systems often utilize suction pipes coupled to elongated suction slots over which a felt passes causing the dewatering thereof.

In systems of this type, a variety of devices exist to create the vacuum necessary for dewatering. For example, liquid ring pumps, positive displacement pumps and centrifugal exhausters or blowers. While many circumstances and operating parameters dictate what type device in this regard is best suited for a particular application, a common desire in which ever type vacuum pump is selected is that it be efficiently incorporated and utilized in the system.

In this regard, generally the vacuum pumps are sized for maximum demand vacuum conditions in the suction pipe when the felt is new. The vacuum pump will normally run at its maximum speed with a new felt. As a felt fabric fills voids during its life, it becomes less permeable requiring a higher vacuum level for dewatering. However, with the decreased felt permeability and since the vacuum pump is a constant volume unit, the vacuum level will automatically increase.

Heretofore, many systems have been devised to take advantage of increasing vacuum conditions and to effect cost and energy saving as a result thereof. See i.e., U.S. Pat. Nos. 4,308,077, issued Dec. 29, 1981; 4,329,201, issued May 11, 1982; and 4,398,996, issued June 19, 1981. For example, in the variable vacuum liquid ring pump having constant flow, as set forth in U.S. Pat. No. 4,398,996, a variable speed drive motor is provided and is responsive to an increase in the vacuum level in the suction pipe. The motor is activated to slow down the vacuum pump as the felt permeability decreases, thereby retaining the desired level in the suction pipe. The lower pump speed results in lower drive horsepower and accordingly a savings in power, while retaining the desired vacuum level in the suction pipe.

While such an arrangement has proven satisfactory in certain applications, it is desired to provide for yet further efficiency and energy savings in a dewatering system, particularly one that utilizes a centrifugal exhauster or blower as compared to a positive displacement unit.

SUMMARY OF THE INVENTION

It is therefor a principal object of the invention to provide for improved efficiency in a dewatering system utilizing a centrifugal exhauster.

It is another object to provide for such improved efficiency which is readily incorporated through minimal changes from existing designs and the use of relatively standard parts.

Accordingly, the present invention provides for a vacuum control system for use in a dewatering system which utilizes a centrifugal exhauster. In this regard, vacuum controls are provided to vary the speed of the exhauster as the permeabilities of the felt decrease with its use. A variable speed drive is coupled with the exhauster and responsive to a change in felt permeability.

While most variable speed drives are set up to run at some maximum speed, then as the demand decreases, the speed is reduced, the present invention does just the opposite. As the vacuum air flow demand decreases due to the reduced felt permeability, the speed of the exhauster is increased to produce a higher vacuum. The higher vacuums are needed to dewater a given felt under decreasing felt permeability when using constant width vacuum slots. The exhauster runs at a slow speed to dewater a new felt.

Rather than using a constant RPM motor drive for the exhauster a variable RPM type is used. The variable speed motor drive for the exhauster may be of the type commonly found in the market place. If such a motor is electric, its speed is preferably varied by varying the AC frequency delivered to the motor. Its maximum speed can be limited by either the maximum current to the motor and/or maximum frequency setting. In the case of a variable frequency drive motor for example, the maximum speed and current may be automatically controlled by using a feedback loop.

Alternatively, a steam turbine variable speed drive may be utilized instead of the electric motor. In this regard, governor controls on the steam turbine drive so as to automatically speed up as the permeability of the felt running over the suction box decreases. The maximum turbine speed may in turn be limited by the maximum steam flow through the nozzles within the turbine.

BRIEF DESCRIPTION OF THE DRAWINGS

Thus by the aforenoted invention, its objects and advantages will be realized, the description of which should be taken in conjunction with the drawings, wherein:

FIG. 2A is a representative performance curve for a constant speed centrifugal exhauster;

FIGS. 3A–C are graphs of the operation of an exhauster under differing conditions incorporating the teachings of the present invention.

DETAILED DESCRIPTION OF THE PREFERRED EMBODIMENT

Figure 1:
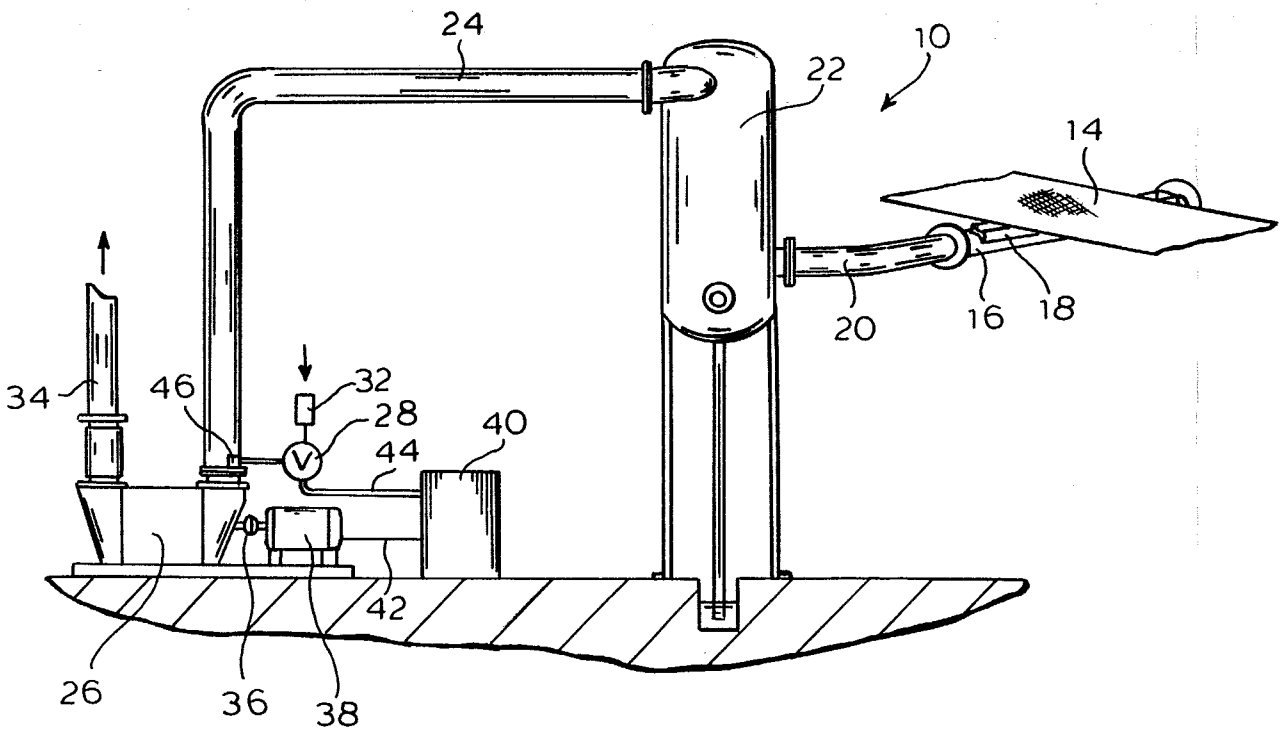
FIG. 1 is a schematic view of the vacuum control system as part of a section of a papermaking machine, incorporating the teachings of the present invention.

The depicted portion 10 is of a well known type of papermaking machine which utilizes one or more suction pipes 12 for dewatering a press felt 14 or similar fabric. The use of several suction pipes is discussed in U.S. Pat. No. 4,329,201. This is a common arrangement at the press section of the papermaking machine.

The typical suction pipes 12 include a hollow conduit 16 with a slot 18 forming an opening in its upper end over which the felt or fabric passes. An exit conduit 20 passes to a conventional type of liquid and gas separator 22. The separator 22 has a bottom exit for passage of separated liquid into a seal pit through a drop leg. The separator 22 is in turn connected by conduit 24 to a vacuum pump 26, which is a centrifugal exhauster type. Such exhauster may be of the type manufactured by Hoffman Air & Filtration Systems, a division of Clarkson Industries, Inc., P. O. Box 214, Eastwood Station, Syracuse, N.Y. 13206. For general background material on exhausters see Publication CBE-378 entitled "Centrifugal Blowers and Exhausters" put out by the aforenoted company.

Typical in such systems, a relief or surge 28 valve is positioned between the separator 22 and the exhauster 26 for vacuum relief purposes when needed. Silencers 32 and 34 are also provided.

A conventional drive shaft 36 interconnects a variable speed drive means 38 with the exhauster 26 to adjust and drive it at a chosen variety of speeds as is hereinafter discussed.

Note that the drive means 38 may be a variable speed drive AC motor of the type manufactured for example by Reliance Electric, 24703 Eucled Avenue, Cleveland, Ohio 44117 (A-C VS Drives; Duty Master-XE; AC Motors; and Max Pak plus); Toshiba Corporation 13-12 Mita 3 chrome, Minato-ku, Tokyo, Japan (MF Pack); Toshiba/Houston International Corporation, 13131 West Little York Road, Houston, Tex. 77041 (ESP-130 series); Parametics, Orange, Conn. Alternatively, a steam turbine such as the type manufactured by Coppus Model #RL-20-L.

The drive means 38 is coupled to a conventional control panel 40 via connection 42 which may be electrical wiring etc. The control panel 40 is coupled through connection 44 to surge valve 28 which in turn is coupled to conduit 24.

The control panel 40 is also electrically connected through connection 44 or any other means suitable for purpose to a pneumatic vacuum sensor 46 which is provided so as to measure the vacuum in the suction pipe at any given time.

As noted, air flow through a felt decreases with age. Heretofore, in a positive displacement unit, by reducing the speed of the vacuum pump with decreasing felt permeabilities provided an advantageous way to save drive power since its power requirement was a function of pump speed. In typical variable speed drives, they are normally set up to run at a maximum speed and then as the demand decreases, its speed automatically slows down.

With a centrifugal exhauster, such a method of operation is not desirable since if the speed of the exhauster is decreased, the vacuum level decreases instead of remaining constant as a positive displacement unit would.

Rather than slowing the speed of the exhauster down, the present invention, via the control panel, serves to speed it up as the felt permeability decreases thereby producing a higher vacuum at the suction pipe. Since the air flow through the felt is less, a higher vacuum at a lower air flow is possible by speeding up the exhauster while maintaining the same drive power. The system allows the exhauster to run at a variable speed to meet the required vacuum at the suction pipe to dewater a felt as it goes from new to old rather than throttling the air flow by turning down a valve as was done heretofore with constant speed exhausters. Also, such a drive system would allow for the automatic adjustment of the exhauster during dewatering of multigrade webs, i.e., light webs at slower speeds; heavier webs at higher speeds.

In the present invention, if an AC motor is utilized, the speed of the motor can be varied by varying the AC frequency delivered to the motor. This is a standard feature in many of the type models of AC motors aforenoted. In a steam turbine drive, the speed of the drive can be similarly regulated by varying the amount of steam.

The operation of the drive means can be readily regulated by the control panel 40 as heretofor will be discussed. The drive means speed can be automatically controlled using a feedback loop arrangement regulating the frequency and/or steam to the desired level. The maximum speed of the motor can be limited to prevent overloading by the maximum current to it or maximum speed or frequency setting. In the steam turbine, the turbine speed is limited by the maximum steam flow through the nozzles in the turbine.

With reference now more particularly to FIG. 2A, the curve depicted shows that the vacuum level with a constant speed (3550 RPM) exhauster varies depending upon the air flow. Accordingly, an exhauster does not have to be a constant vacuum unit, instead it depends on the combination of impellers selected for each application. This provides the flexibility to optimize the hp requirements for a given application. For felt dewatering, a performance curve would normally be selected that would generally have low vacuum levels under new felt conditions and higher vacuums under reduced felt permeability conditions. The vacuum is allowed to vary from a low level under new felt conditions to a maximum level when needed at reduced felt permeabilities. Monitoring the vacuum with time throughout a given felt life may be provided by way of a vacuum monitor. If the exhauster energy requirements were measured throughout the life of the felt, a substantial reduction in energy is realized.

Figure 2B:
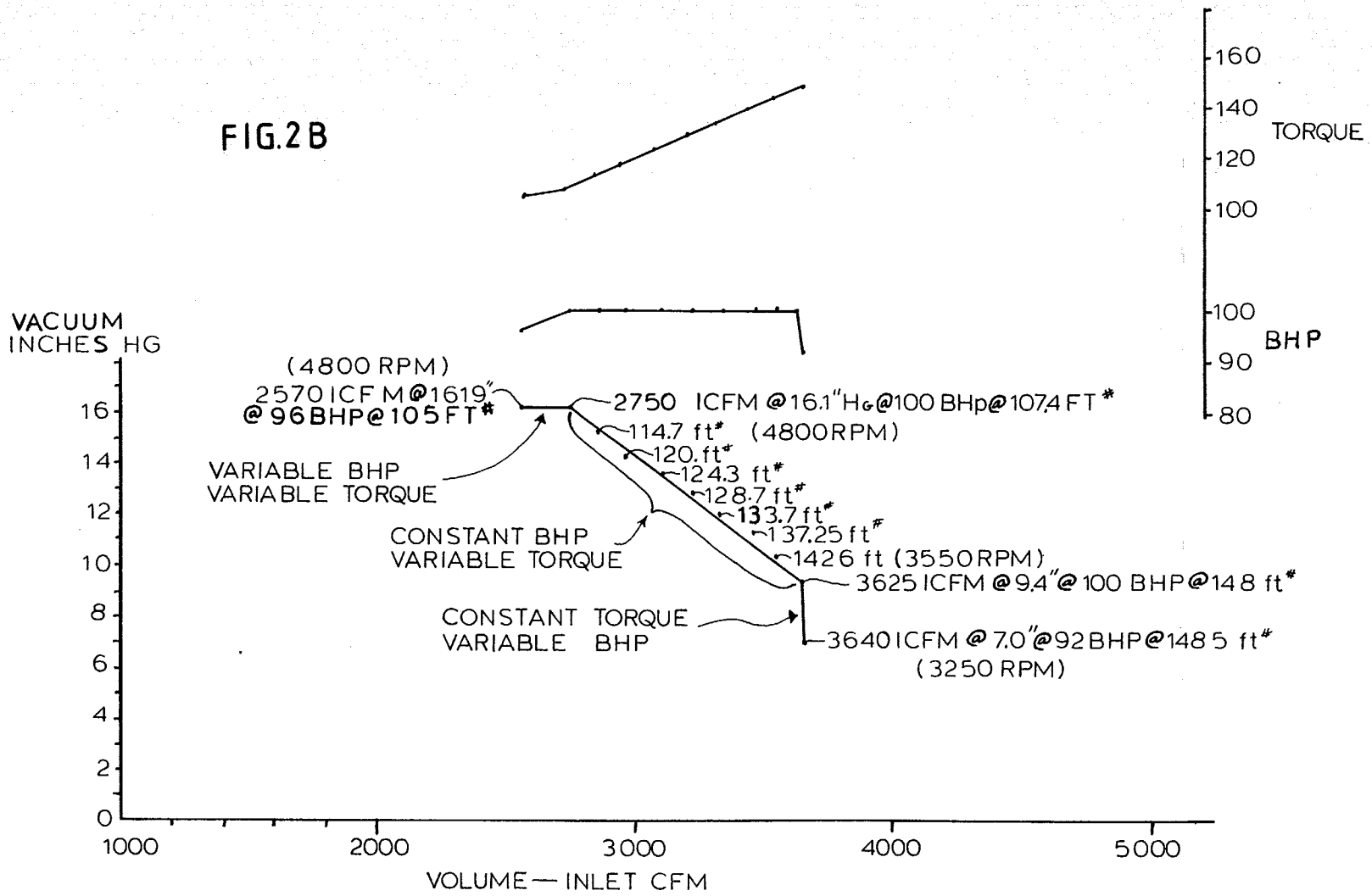
FIG. 2B is a performance curve for a particular variable speed centrifugal exhauster, incorporating the teachings of the present invention.

Regarding FIG. 2B, there is shown the performance curve for a variable speed centrifugal exhauster, of the present invention in particular a Hoffman Model #75105A, under inlet air conditions of 29.92 inches Hg, 68° F. and 38% RH. The particular results achieved are shown on the graph as the speed of the exhauster increases producing the desired higher vacuums.

The dramatic decrease in the energy required for a felt fabric dewatering process by using a variable speed drive with a centrifugal exhauster will be apparent from the following examples.

EXAMPLE NUMBER 1

As aforenoted, felt fabric fills its voids and becomes less permeable (scfm flow decreases) with age, causing the vacuum level required for dewatering to rise. With a constant flow, variable vacuum liquid ring style pump, the horsepower increases as the vacuum level increases over the life of the felt fabric. However, with a centrifugal exhauster, as the air flow decreases through the fabric over its life, the horsepower decreases.

Figure 3A:
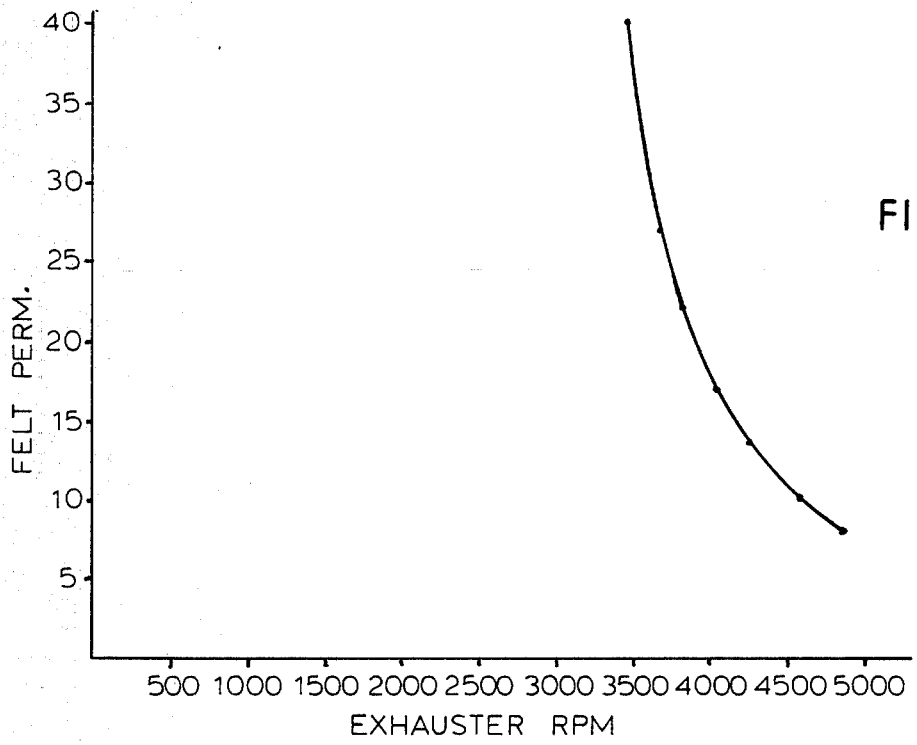

For example, a felt fabric has a permeability of 40 scfm per square inch at 0.5" $H_2O$ when the fabric is brand new. It is assumed that the life of the felt will extend down to a permeability level of 8 scfm per square inch at 0.5" $H_2O$. Seven points of data between and including the permeabilities of 40 and 8 are plotted on FIG. 3A.

The maximum vacuum is limited at 15.7" Hg and the felt fabric dewatering rate is assumed to be 0.13 lbs. of water per lb. of felt.

Figure 3B:
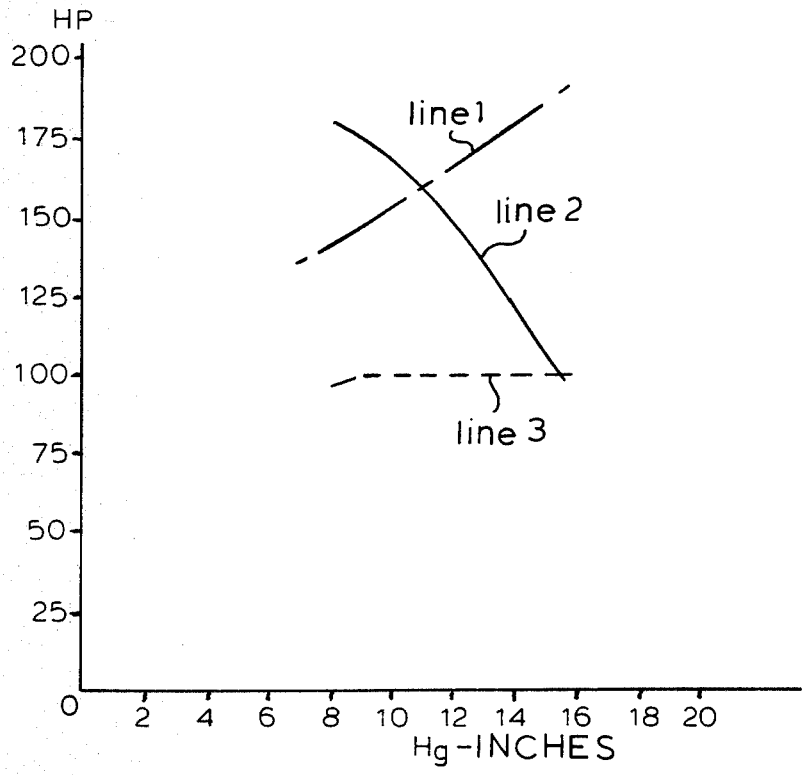

By plotting the energy (horsepower) required versus vacuum level for these seven data points (see FIG. 3B) and calculating the area under the three appropriate curves, a liquid ring pump (line 1) requires the greatest amount of energy over the life of the felt fabric. A 3600 rpm constant speed exhauster (line 2) requires 31% less energy than the liquid ring pump over the life of the same felt fabric. However, the variable speed drive centrifugal exhauster uses 62% less energy than the liquid ring pump application.

With a variable speed drive motor below approximately 3600 rpm, the horsepower will vary and the torque will be constant. Above approximately 3600 rpm, the horsepower will be constant with the torque variable. In the present example, with a variable speed AC induction drive motor, while the horsepower ranged from 96 hp to 100 hp for the variable speed drive exhauster, the torque requirements were decreasing from 147.8 foot-lbs. down to 105 foot-lbs. The rpm range started at approximately 3425 and increased to approximately 4850 rpm.

The following comparison table serves to illustrate the advantageous operation of the centrifugal exhauster provided by the present system.

| NEW VARIABLE SPEED CENTRIFUGAL EXHAUSTER (Hoffman Model #75105A-221) | | | | | | | | LIQUID RING PUMP (Nash Model #CL4001 400 rpm) | | | | | | | |
|---|---|---|---|---|---|---|---|---|---|---|---|---|---|---|---|
| Perm | 40 | 30 | 25 | 20 | 15 | 10 | 8 | Perm | 40 | 30 | 25 | 20 | 15 | 10 | 8 |
| $M_B$ | .83 | .76 | .74 | .72 | .705 | .685 | .676 | $M_B$ | .83 | .77 | .738 | .705 | .673 | .668 | .676 |
| $M_A$ | .70 | .63 | .61 | .59 | .575 | .555 | .546 | $M_A$ | .70 | .64 | .608 | .575 | .543 | .538 | .546 |
| Machine Speed | 4000 | 4000 | 4000 | 4000 | 4000 | 4000 | 4000 | Speed | 4000 | 4000 | 4000 | 4000 | 4000 | 4000 | 4000 |
| Slot | 3" | 3" | 3" | 3" | 3" | 3" | 3" | Slot | 3" | 3" | 3" | 3" | 3" | 3" | 3" |
| Width | 158" | 158" | 158" | 158" | 158" | 158" | 158" | Width | 158" | 158" | 158" | 158" | 158" | 158" | 158" |
| acfm | 4437 | 4264 | 4040 | 3762 | 3302 | 2810 | 2582 | acfm | 4150 | 4095 | 4079 | 4076 | 4054 | 3192 | 2582 |
| "Hg | 8.0 | 9.1 | 10.1 | 11.3 | 12.6 | 14.6 | 15.7 | "Hg | 6.9 | 8.8 | 10.2 | 12.0 | 14.4 | 15.7 | 15.7 |
| BHP | 96 | 100 | 100 | 100 | 100 | 100 | 100 | BHP | 135 | 145 | 155 | 165 | 185 | 190 | 190 |
| rpm | 3425 | 3580 | 3700 | 3900 | 4175 | 4570 | 4850 | | | | | | | | |
| Constant Speed Centrifugal Exhauster (Hoffman Model #74109-236) 3600 rpm | | | | | | | | | | | | | | | |
| BHP | 180 | 177 | 167 | 158 | 138 | 110 | 98. | | | | | | | | |

Thus the present invention provides for the advantages of greatly reducing the energy required while achieving higher vacuum levels. Also, in certain applications the use of one exhauster unit rather than two units in series may be sufficient.

EXAMPLE NUMBER 2

A particular new felt requires 4150 acfm at 6.9" Hg. Again, a Hoffman Model #75105A-221 centrifugal exhauster is used in conjunction with a variable speed 100 hp AC motor, 111 full load amps, 92.5% power factor, 91.5% efficiency, 460 volts at a speed of 3550 rpm. A maximum vacuum requirement of at least 15" Hg is selected with the drive motor current limit, 111 amps; exhauster speed, 4850 rpm with a maximum speed of 5000 rpm.

Starting with the new felt, the exhauster wants to run at 4850 rpm, but it cannot since it would exceed the 111 amps current limit. Accordingly, it runs at a slower speed requiring approximately 111 amps. In this present example, the exhauster would run at 3425 rpm requiring approximately 96 bhp which is the maximum bhp the 100 hp drive motor can produce at a speed of 3425 rpm. Such an arrangement is utilized since in the particular variable frequency AC drive system utilized in this example, there will be a constant torque and variable hp below 3550 rpm and constant horsepower and variable torque above 3550 rpm.

BHP calculations are as follows:

$$\text{BHP} = \frac{(\text{Voltage})\,(\text{Amps}) \times (\text{Power Factor})\,(\text{Eff.})}{431}$$

-continued

BHP 3550 rpm 60 Cycles (Hz) =

$$\frac{\left(460 \times \frac{60}{60}\right)(111) \times (.925)\,(.915)}{431} = 100 \text{ BHP}$$

BHP 3425 rpm 57 Cycles (Hz) =

$$\frac{\left(460 \times \frac{57}{60}\right)(111) \times (.925)\,(.915)}{} = 95.3 \text{ BHP}$$

From these calculations the volts per Hz (7.66) are constant below 3550 rpm resulting in a constant torque drive in this region.

Above 3550 rpm the maximum voltage at the drive motor is 460 volts. Therefore, the volts per (Hz) are decreasing resulting in a variable torque drive.

$$\text{BHP 4850 rpm 82 Cycles (Hz)} = \frac{(460)\,(111) \times (.925)\,(.915)}{431} = 100 \text{ BHP}$$

EXAMPLE NUMBER 3

This example relates to the use of a steam turbine such as for example a Coppus steam turbine Model #RL-20L, to drive the exhauster, Hoffman Model #75106A, having 220 impellers running at a speed of 3000 rpm using 136 hp.

The specifications of the turbine are as follows:

| Steam Condition | 250 psig in and 300 psig out | | |
|---|---|---|---|
| Speed (RPM) | 3000 | 3500 | 4000 |
| BHP | 134 | 147 | 157 |

Under new felt conditions, the turbine and exhauster would start to run at approximately 3000 rpm. The turbine at 3000 rpm is putting out approximately 134 BHP which is approximately 136 BHP, the exhauster requires.

To develop higher vacuums when the felt permeability decreases, the speed adjustment on the turbine governor would be set to a maximum speed that the exhauster is to run at under reduced felt permeability conditions. In the present example, the governor would be set at 4000 rpm to develop a maximum vacuum at the exhauster of 14.9" Hg. Assuming constant steam conditions at the governor valve inlet and a constant turbine discharge pressure then the ΔP and steam flow rate is also constant through the turbine. This remains true until the turbine reaches its maximum speed and the governor valve starts to throttle, keeping the turbine at its maximum speed.

At varying felt permeability, the results are as follows:

| Permeability | 70 | 33 | 21 | 15 |
|---|---|---|---|---|
| MB | .7 | .62 | .59 | .6 |
| MA | .6 | .52 | .49 | .5 |
| Vac " Hg | 7 | 12.4 | 14.9 | 14.9 |
| Speed FPM | 2000 | 2000 | 2000 | 2000 |
| Slots | 1.25" | 1.25" | 1.25" | 1.25" |
| Felt Width | 256" | 256" | 256" | 256" |
| Suction Box Air Flow & Vacuum | 5620 @ 8" | 4700 @ 12.4 | 4000 @ 14.9 | 2962 @ 14.9 |
| BHP | 136 | 147 | 157 | *144 |

* It should be noted that the surge point on this exhauster at 4000 rpm is approximately 3662 cfm at 144 BHP. Once the exhauster comes up to maximum speed, if the BHP requirements fall below 144 BHP appropriate steps should be taken to avoid surge. Note also that this steam arrangement is very similar to that involving the variable AC motor drive in that once the exhauster speed comes up to its limit, the pre-set maximum speed setting for the AC motor limits the speed to its setpoint. With the turbine system the governor value takes over controlling the speed to its setpoint.

Thus the several aforenoted objects and advantages of the present invention are most effectively realized and although a preferred embodiment has been disclosed and described in detail herein, it should be understood that the invention is in no sense limited thereby and its scope is to be determined by that of the appended claims.

What is claimed is:

1. In a vacuum control system for dewatering a press fabric on a papermaking machine including a suction pipe, a centrifugal exhauster connected to the suction pipe to provide a desired vacuum level to the fabric passing over a slot in the suction pipe so that suction applied therethrough will dewater the fabric, the improvement comprising: control means which includes a variable speed drive means connected to the centrifugal exhauster coupled to the suction pipe, said control means being responsive to a change in the air flow in the suction pipe as fabric permeability decreases and air flow demand decreases to correspondingly raise the speed of the variable speed drive means and accordingly the centrifugal exhauster while the drive load of the drive means remains substantially the same so as to increase vacuum level in the suction pipe as a function of the decrease in fabric permeability and air flow demand.

2. The invention in accordance with claim 1 wherein the fabric is a paper maker's press felt.

3. The invention in accordance with claim 1 wherein the variable speed drive means comprises an AC motor.

4. The invention in accordance with claim 3 wherein the control means includes a means of limiting the maximum speed of the AC motor.

5. The invention in accordance with claim 1 wherein the variable speed drive means comprises a steam turbine.

6. The invention in accordance with claim 5 wherein the control means includes a means of controlling the maximum speed of the steam turbine.

7. The invention in accordance with claim 1 wherein the variable speed drive means comprises a AC motor for driving the centrifugal exhauster and said control means includes a means of controlling said motor by limiting the maximum current or frequency.

8. A method of controlling vacuum conditions in a papermaking machine at the suction box section thereof which includes a centrifugal exhauster connected to a suction pipe to supply a desired vacuum level in the suction pipe so that suction applied therethrough will dewater a fabric passing over the suction pipe, the improvement steps comprising: driving the centrifugal exhauster by a variable speed drive motor; adjusting the speed of the centrifugal exhauster through a controller connected to the drive motor which is automatically responsive to a change in the air flow in the suction pipe as fabric permeability decreases and air flow demand decreases to correspondingly raise the speed of the drive motor and according the centrifugal exhauster while the drive load of the drive motor remains substantially the same and increase the vacuum level in the suction pipe as a function of the decrease in fabric permeability and air flow demand.

9. The method in accordance with claim 8 wherein the controller is used to regulate a variable speed AC motor for operating the centrifugal exhauster.

10. The invention in accordance with claim 9 which includes limiting the maximum speed of the AC motor.

11. The invention in accordance with claim 9 which includes limiting the maximum speed of the steam turbine.

12. The method in accordance with claim 8 wherein the controller is used to regulate a variable speed steam turbine for operating the centrifugal exhauster.

13. The invention in accordance with claim 9 which includes limiting the maximum current or frequency of the AC motor.

* * * * *

UNITED STATES PATENT AND TRADEMARK OFFICE

CERTIFICATE OF CORRECTION

PATENT NO. : 4,551,202

DATED : November 5, 1985

INVENTOR(S) : Bolton et al.

It is certified that error appears in the above-identified patent and that said Letters Patent is hereby corrected as shown below:

Col. 1, Line 22, "ever" should be --every--;

Col. 6, Line 14, insert --431-- as the denominator;

Col. 6, Line 52, "300" should be --30--;

Col. 8, Line 33, "according" should be --accordingly--.

Signed and Sealed this

*Second* Day of *September 1986*

[SEAL]

*Attest:*

DONALD J. QUIGG

*Attesting Officer*

*Commissioner of Patents and Trademarks*

UNITED STATES PATENT AND TRADEMARK OFFICE

CERTIFICATE OF CORRECTION

PATENT NO. : 4,551,202

DATED : November 5, 1985

INVENTOR(S) : Bolton et al.

It is certified that error appears in the above-identified patent and that said Letters Patent is hereby corrected as shown below:

Page 1, insert the following under the section designated "Other Publications":

"Control Pumps with Adjustable-Speed Motors and Save Energy", Reliance Electric Company, OH, Ed. Reprint D-5043, May, 1981

"MF Pack - High-Power High-Performance Load Commutated Inverter", Toshiba Corporation, Tokyo, Japan, 1982

"Hoffman - Centrifugal Blowers & Exhausters", Hoffman Air & Filtration Systems, NY, CBE-378

Connors and Jarc, "Application Considerations for A-C Drives", Reliance Electric Company, OH; 1982

"Adjustable Speed Drives As Applied To Centrifugal Pumps", Reliance Electric Company, OH; Oct., 1981

"Considerations in Applying Induction Motors with Solid State Adjustable Frequency Controllers", Reliance Electric Company, OH; Dec., 1982

"Energy Efficiency and Electrical Adjustable Speed Drives", Reliance Electric Company, Ed. Reprint D-5042, Fed., 1981

UNITED STATES PATENT AND TRADEMARK OFFICE

CERTIFICATE OF CORRECTION

PATENT NO. : 4,551,202

DATED : November 5, 1985

INVENTOR(S) : Bolton et al.

It is certified that error appears in the above-identified patent and that said Letters Patent is hereby corrected as shown below:

Column 1, Line 22, change "ever" to --every--.

Column 6, Line 14, insert --431-- as the denominator.

Signed and Sealed this

Third Day of February, 1987

*Attest:*

DONALD J. QUIGG

*Attesting Officer*

*Commissioner of Patents and Trademarks*